US011873626B2

(12) United States Patent
Youngquist, Jr. et al.

(10) Patent No.: US 11,873,626 B2
(45) Date of Patent: Jan. 16, 2024

(54) LARGE DIAMETER WATER WELL CONTROL

(71) Applicant: Youngquist Brothers, LLC, Myers, FL (US)

(72) Inventors: Harvey Bruce Youngquist, Jr., Fort Myers, FL (US); Brett Alan Youngquist, Fort Myers, FL (US)

(73) Assignee: Youngquist Brothers, LLC, Fort Myers, FL (US)

( * ) Notice: Subject to any disclaimer, the term of this patent is extended or adjusted under 35 U.S.C. 154(b) by 31 days.

(21) Appl. No.: 17/146,781

(22) Filed: Jan. 12, 2021

(65) Prior Publication Data

US 2021/0214924 A1 Jul. 15, 2021

Related U.S. Application Data

(60) Provisional application No. 62/961,523, filed on Jan. 15, 2020.

(51) Int. Cl.

| | |
|---|---|
| ***E21B 7/28*** | (2006.01) |
| ***E03B 3/15*** | (2006.01) |
| ***E21B 21/01*** | (2006.01) |

(52) U.S. Cl.

CPC ..... *E03B 3/15* (2013.01); *E21B 7/28* (2013.01); *E21B 21/01* (2013.01)

(58) Field of Classification Search

CPC ..... E21B 7/28; E21B 21/01; E21B 33/068; E21B 34/02; E21B 21/085

See application file for complete search history.

(56) References Cited

U.S. PATENT DOCUMENTS

| | | | | |
|---|---|---|---|---|
| 1,900,164 | A * | 3/1933 | Dana | E21B 7/061 175/61 |
| 2003/0220742 | A1* | 11/2003 | Niedermayr | E21B 44/00 702/9 |
| 2004/0084189 | A1* | 5/2004 | Hosie | E21B 34/101 166/66 |
| 2016/0053542 | A1* | 2/2016 | Stafford | E21B 7/00 175/69 |

* cited by examiner

*Primary Examiner* — D. Andrews
*Assistant Examiner* — Ronald R Runyan
(74) *Attorney, Agent, or Firm* — Ted D. Lee; Brandon T. Cook; Gunn, Lee & Cave, P.C.

(57) ABSTRACT

A large diameter injection water well is drilled using a drilling derrick and rotary drilling techniques after snubbing in and drilling a short distance with drilling mud, a temporary drilling header is installed below the blowout preventers. Extending downward from the temporary drilling header is a drop pipe with a valve on the lower end thereof. Drilling pipe with attachments on the lower end thereof, are lowered into the drop pipe with the valve closed. After sealing to the drilling pipe, the valve is opened and the drilling pipe and attachments are lowered to the bottom of the well for the normal drilling operation. Thereafter, the drilling pipe and attachments are removed reversing the process of retracting into the drop pipe and closing the valve before removing the seal from the drilling pipe. The repeated insertion of the drilling pipe with various attachments on the end thereof in the drilling procedure occurs without having to kill or suppress the well until the final step when removing the drop pipe.

6 Claims, 6 Drawing Sheets

LARGE DIAMETER WATER WELL CONTROL

CROSS-REFERENCE TO RELATED PATENTS

This is an improvement over patent application Ser. No. 15/987,409 filed on May 23, 2018 which issued on Dec. 3, 2019 as U.S. Pat. No. 10,494,896, and a formal utility patent application claiming priority to Provisional Patent Application No. 62/961,523 filed on Jan. 15, 2020, both of which are incorporated herein by reference.

BACKGROUND OF INVENTION

Field of the Invention

This invention relates generally to the drilling of a large diameter injection well, more particularly, to the control of artesian flow without the use of weighted well drilling material such as salt or barite.

Description of the Prior Art

Perforations in the earth's surface to find and release hydrocarbons is well known. Typically an oil well is created by a drilling hole into the earth with a drilling rig that rotates a drill string with a bit attached to the lower end. As the hole is drilled to an ascribed depth, sections of steel casing are set in a hole. The casing is slightly smaller in diameter than the borehole. The casing provides structural integrity to the newly drilled wellbore and isolates zones from each other and from the surface. As the well is drilled deeper, smaller casing and smaller bits are used.

Generally, the same type of equipment used in drilling an oil and/or gas well can be used in drilling injection wells from the surface. In the state of Florida, injection wells have been used for disposal of both storm water and municipal waste water for many years. In Florida, disposal of municipal waste water, including treated waste water, is injected deep underground into highly permeable rock formations that naturally contain saline water. The geological formation that most commonly receives the injected water is the lower most portion of the Floridian Aquifer System, which is between the depths of approximately 2,500 to 3,400 feet below the land surface. The formation at this depth is made up of limestone and dolostone which contain highly transmissive solution channels. This zone is commonly referred to as the "Boulder Zone".

The Boulder Zone has highly brackish water with a salinity that is similar to seawater. Separating the brackish water from the fresh water contained in the Surficial Aquifer are intermediate layers of less permeable clays which are 300 or more feet thick.

A typical injection well will be about sixty inches in diameter at the top going down to about 24 inches in diameter at the bottom. The injection wells operate at very low pressure normally around 20 PSI. The injection wells are used to dispose of run-off water that should not be released into the streams, but is not heavily polluted water that might be found in an oil field environment.

The upper part of the injection well is the largest diameter and typically would have casing of approximately 54 inches in diameter cemented into place for approximately 100 feet in what is commonly known as "snubbing in." After snubbing in, a slightly smaller diameter hole and a smaller diameter casing will be set as the injection well is being drilled. Each time a string of casing is installed and cemented into place, a pilot hole of typically 12 inches in diameter is drilled a few hundred feet past the expected length of the next string of casing. The pilot hole is for testing using both geophysical logging tools and inflatable packers to determine the best depth for the next string of casing or completion of the well. Typically, there would be three to five sets of subsequently smaller hole sizes being drilled, each drilled inside of one another and each cemented with a different diameter casing.

Throughout the drilling process, typically a temporary drilling header, sometimes referred to as a "rotating control device," is used at the surface to control or prevent artesian flow out of the well. The temporary drilling header includes stripping rubber that seals around the drill pipe while allowing a drill pipe to move up and down. The stripping rubber removes material stuck to the drill pipe. The problem with this type of temporary drilling header is that the bit, weights, and/or drill collars are larger in diameter than the drill pipe. While the drill pipe can go through the temporary header, these larger diameter devices cannot.

In the past, when inserting or removing the larger diameter devices from the well, the temporary drilling header had to be removed. To remove the temporary drilling header, the well would have to be killed using a heavy drilling mud. The killing or suppressing of a well during the drilling process is time consuming and expensive. A heavy drilling mud would need to be mixed and injected into the well, which heavy drilling mud would then intermix with native well bore fluids. It may later be difficult to remove the heavy drilling mud from the native well bore fluids. Also, the possibility of loss of well control during well suppression or killing activities could occur. While salt and barite are the two most common materials used to create a heavy drilling mud to kill and/or suppress the well, other materials could also be used. In large artesian aquifer zones, it is common to use a truckload or more of salt or barite to mix into slurry each time a well is killed. During the typical construction of a large diameter injection well, the well is suppressed/killed approximately twenty times.

While drilling an injection well and setting the first two strings of casing, the well bore is filled with bentonite drilling fluid, commonly called "mud". The mud is pumped down through the drilling pipe and returns to the surface between the outside of the drilling pipe and the well bore. The mud carry the cuttings suspended therein.

After the second string of casing is cemented, the mud is evacuated from the casing and replaced with water. From this point forward, drilling fluid (mud) is no longer used with the present invention.

SUMMARY OF THE INVENTION

It is an object of the present invention to control artesian flow while drilling an injection well without using a weighted drilling fluid.

It is another object of the present invention to reduce the number of times a large diameter water well must be killed or suppressed during drilling.

It is yet another object of the present invention to have a temporary drilling header at the top of a large diameter disposal well during the drilling process, which temporary drilling header is installed after the disposal well is snubbed in. A second casing is set down to approximately 1000 feet in depth. After installing the temporary drilling header, a drop pipe is installed that extends below the temporary drilling header. The drop pipe is connected to the temporary drilling header by any convenience means, such as bolted to flanges or a welded connection to the previously installed casing. Above the temporary drilling header on the drill pipe is connected a rotating control device with stripper rubber for cleaning the drill pipe as it goes in or out of the well. Connected to a lower end of the drop pipe is a valve operated by a hydraulic cylinder to open or close the lower end of the drop pipe. By the use of the drop pipe, access to the inside of the disposal well being drilled can be obtained without killing or suppressing the well.

In the past, if the temporary drilling header had to be removed to set drill collars, replace drill bits, do geographical logging or anything else requiring larger diameter items pass through temporary drilling header to access lower regions of the disposal well, the disposal well would have to be killed or suppressed by using heavy drilling fluid to stop any artesian flow. By use of a drop pipe with a hydraulically actuated lower valve, it is not necessary to kill the well when moving larger diameter items through the temporary well header via the drop pipe.

A bottom hole assembly can be lowered through the temporary well header into the drop pipe when the valve on the lower end of the drop pipe is closed. Thereafter, the rotating control device and a stripper rubber is secured against the drill pipe so that when the lower valve is open, there will not be any artesian flow from the well being drilled.

In the drilling of a disposal well, pilot holes are drilled beyond the lower end of the casing, which pilot holes are used for geophysical logging tools and inflatable packers. Also, if samples need to be obtained, they can be obtained by having a bottom hole assembly connecting through the temporary drilling header into the drop pipe while the lower valve of the drop pipe is closed. Thereafter, once the rotating control device and stripper rubber are in place, the lower valve on the drop pipe can be opened and the bottom hole assembly lowered to collect samples. This typically occurs several times for each disposal well. By use of the drop pipe and the hydraulically operated valve, this can be done repeatedly without having to kill or suppress the well. The length of the drop pipe is determined by the bottom hole assembly that is to be used in drilling the injection well. Typically the drop pipe that would be two to three hundred feet in length. By using the drop pipe, large amounts of heavy fluid to suppress or kill the artesian flow from the well is no longer necessary.

DESCRIPTION OF THE PREFERRED EMBODIMENT

Figure 1:
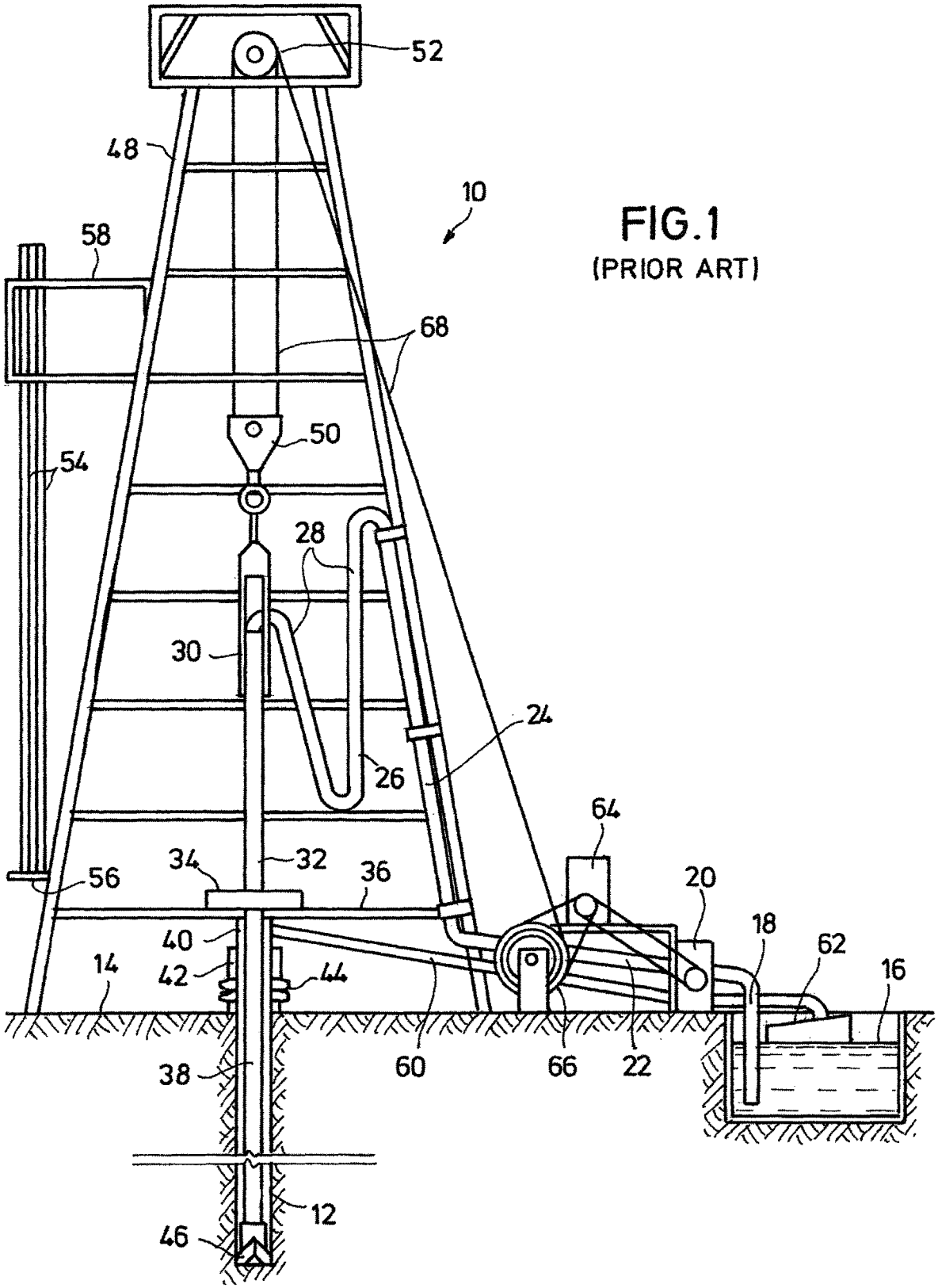
FIG.1 (PRIOR ART)
FIG. 1 is a pictorial illustration of a prior art oil drilling rig.

Before explaining the present invention, an explanation as to how an oil well is drilled is helpful. Referring to FIG. 1, a simplified pictorial representation of an oil field derrick 10 drilling an oil well 12 in the earth's surface 14 is shown. A mud tank 16 holds a drilling mud, such as barite, which may be delivered via a suction line 18 to mud pump 20, through vibrating hose 22, standpipe 24, kelly hose 26, goose necks 28, swivel 30 to Kelly drive 32. From the Kelly drive 32, the drilling mud travels through the rotary table 34 and drilling floor 36 to the drill string 38. However, before reaching the drill string 38, the drilling mud must travel through bell nipple 40, an angular blowout preventer 42, and ram blowout preventers 44.

While FIG. 1 shows a rotary table 34, a tophead rotary drive may be used. Either one uses rotary drive to turn the drill string 38.

As the rotary table 34 turns the drill string 38 drilling mud from the mud tanks 16 is delivered under pressure through drilling string 38 to the drill bit 46. As the oil well 12 is drilled deeper, derrick 48 uses traveling block 50 and crown block 52 to add additional drill pipes from the stand 54 of drill pipes, which stand 54 holds the pipe rack 56 by monkey board 58. As additional pipe is added to the drill string 38, flow of the mud from the mud tank 16 is stopped. The weight of the drilling mud will keep pressures inside the oil well 12 from blowing out the top of the oil well 12. Blow out preventers 42 and 44 also ensure that pressures inside of the oil well 12 will not escape.

Mud from the mud tank 16 flows into the oil well 12 by flowing downward through the drill string 38. The mud returns between the drill string 38 and the well 12 being drilled in the earth simultaneously carrying any cuttings to the surface. The returning mud and cuttings flows through flow line 60 to a shell shaker 62 for removal of cuttings before returning the mud to the mud tank 16.

Motor 64 with draw works 66 operate drill lines 68 to move traveling block 50 and rotate crown block 52 when adding more pipe from stand 54 to the drill string 38. This is a simplified description of how an oil well is drilled using standard techniques.

Figure 3:
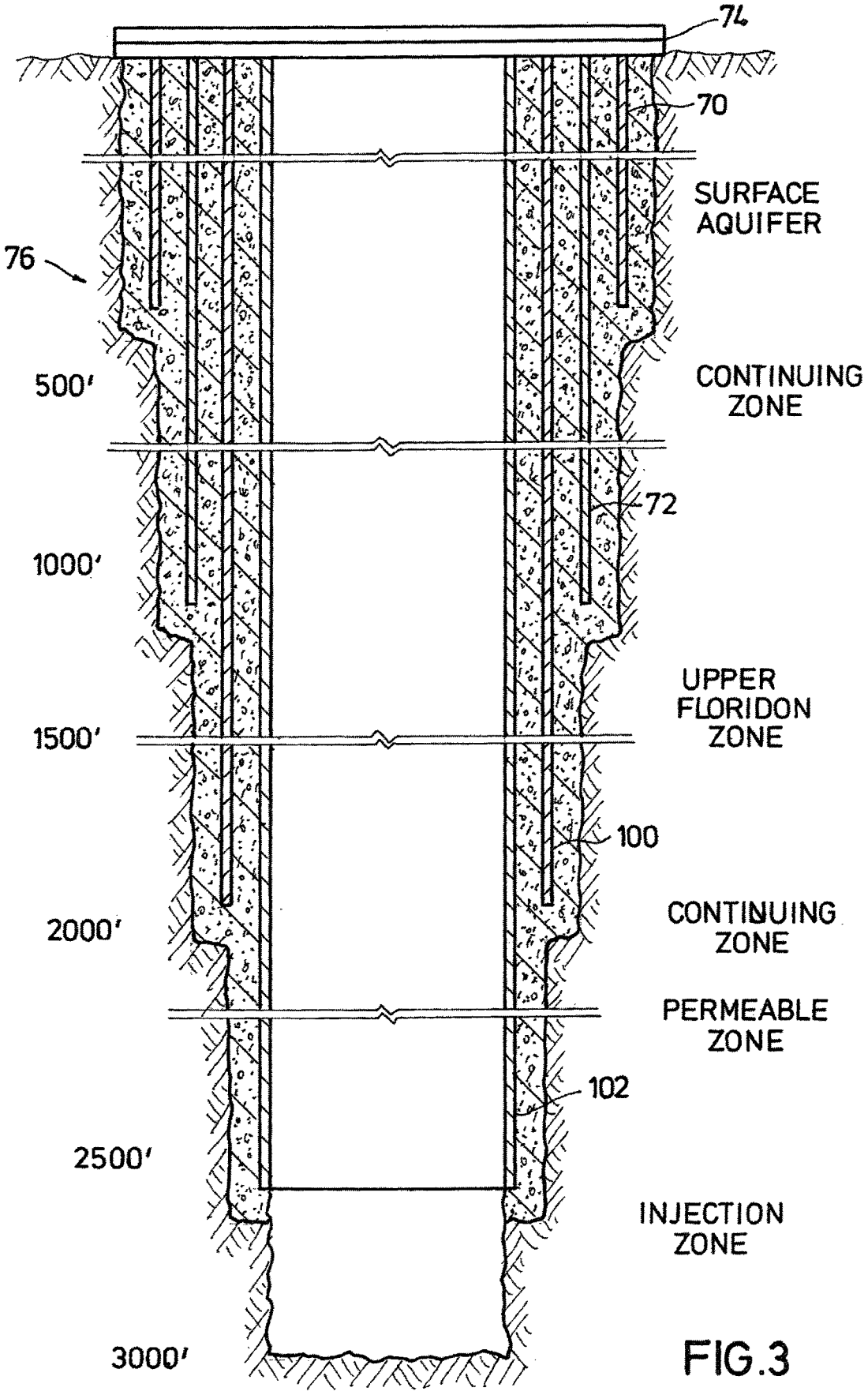
FIG. 3 is an illustrative sectional view of the underground portion of a large diameter injection water well.

In the drilling of the large diameter disposal water wells, similar techniques are used during the drilling process. A large diameter disposal water well that might be drilled in central or southern Florida would typically be snubbed in with a 54 inch steel casing 70. See FIG. 3. After the 54 inch steel casing 70 is cemented into place, mud will continue to flow through the drill string 38. See FIG. 1. Subsequently, a 44 inch steel casing 72 will have to be installed and cemented into place down to approximately 1000 feet in depth. Through the cementing in place of the 44 inch steel casing 72, drilling mud may be used, which drilling mud is pumped down through a drill string 38 and up through the annulus back to the surface. Everything through this point is the same as the prior art except there are larger diameters and lower pressures.

Figure 2:
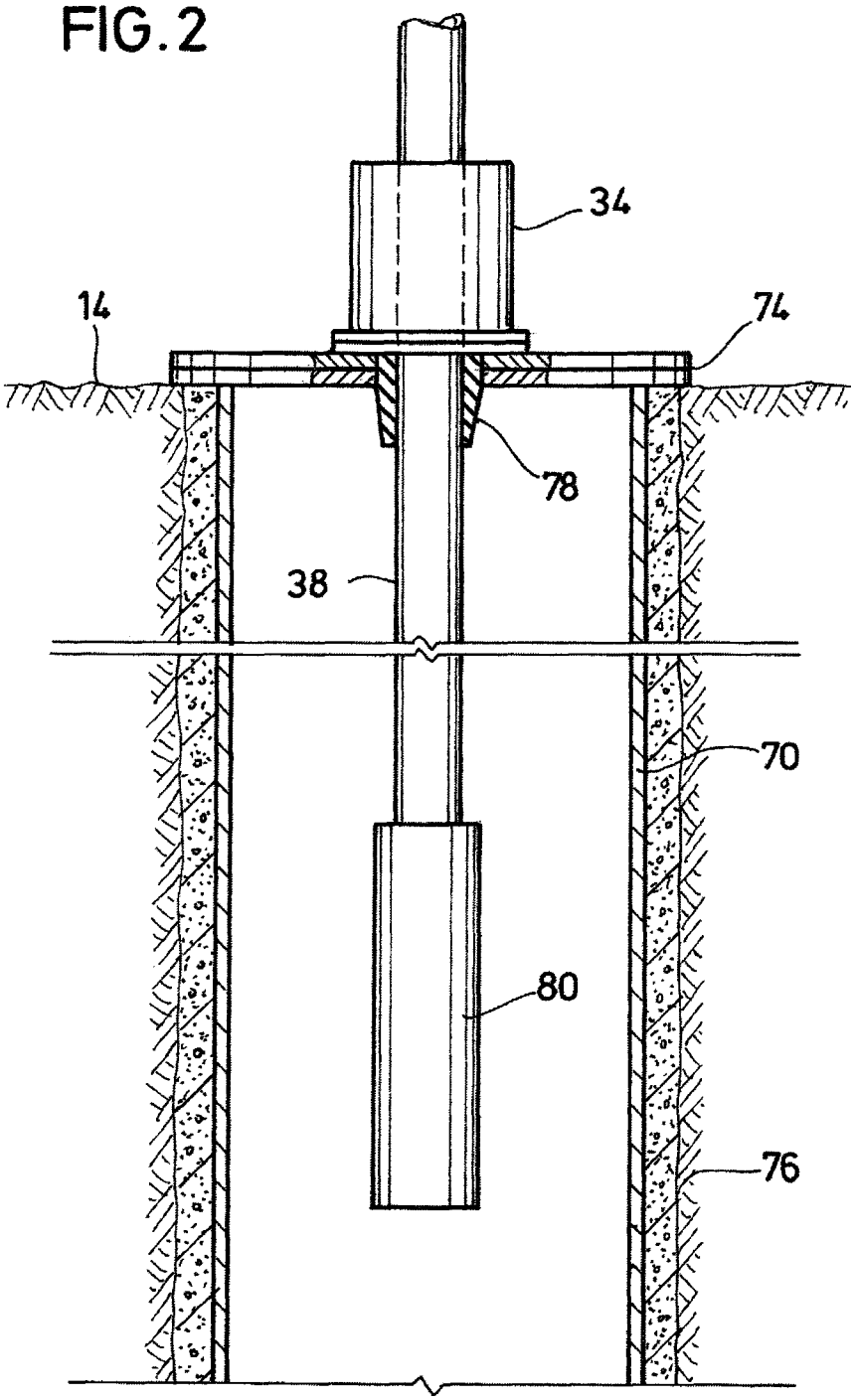
FIG. 2 is a simplified, partial, cross-sectional view of the upper portion of a large diameter injection water well being drilled.

Upon setting the 44" steel casing 72 into place the drilling mud is removed and a temporary drilling header 74 is installed. See FIG. 2. The temporary drilling header 74 is located below the blowout preventers 42 and 44. See FIG. 1. The next step in drilling the disposal water well is to drill a pilot hole approximately twelve inches in diameter to approximately two-thousand feet. The temporary drilling header 74 is normally installed after the drilling of the pilot hole. Typically, three or four core samples will be needed when drilling from 1000-2000 feet in depth. This requires tripping the drill string 38 out of the well 76. To prevent artesian flow therefrom, the well 76 will have to be either suppressed or killed. As the drill string 38 is removed from the well 76 as shown in FIG. 2, stripper rubber 78 will remove material from the drill string 38. On the bottom of the drill string 38 is located bottom hole assembly 80. The bottom hole assembly 80 may be a drill bit, packer, coring bell, a logging device, etc. However, the bottom hole assembly 80 normally cannot get past the rubber stripper 78 and/or temporary drilling header 74 nor past the rotary table 34. In the past, each time the bottom hole assembly 80 has to come out of the well 76, pressures inside the well 76 have to be either killed or suppressed. Previously, to kill or suppress pressures inside of the well 76 required a large amount of barite or salt to mix into a drilling mud. It is expensive and time consuming to have to kill or suppress the well using large amount of salt or barite. When drilling operations are to be resumed, the drilling mud or slurry will need to be reduced and/or removed from the well 76. The weight of the slurry/drilling mud prevents artesian flow from well 76.

Figure 4:
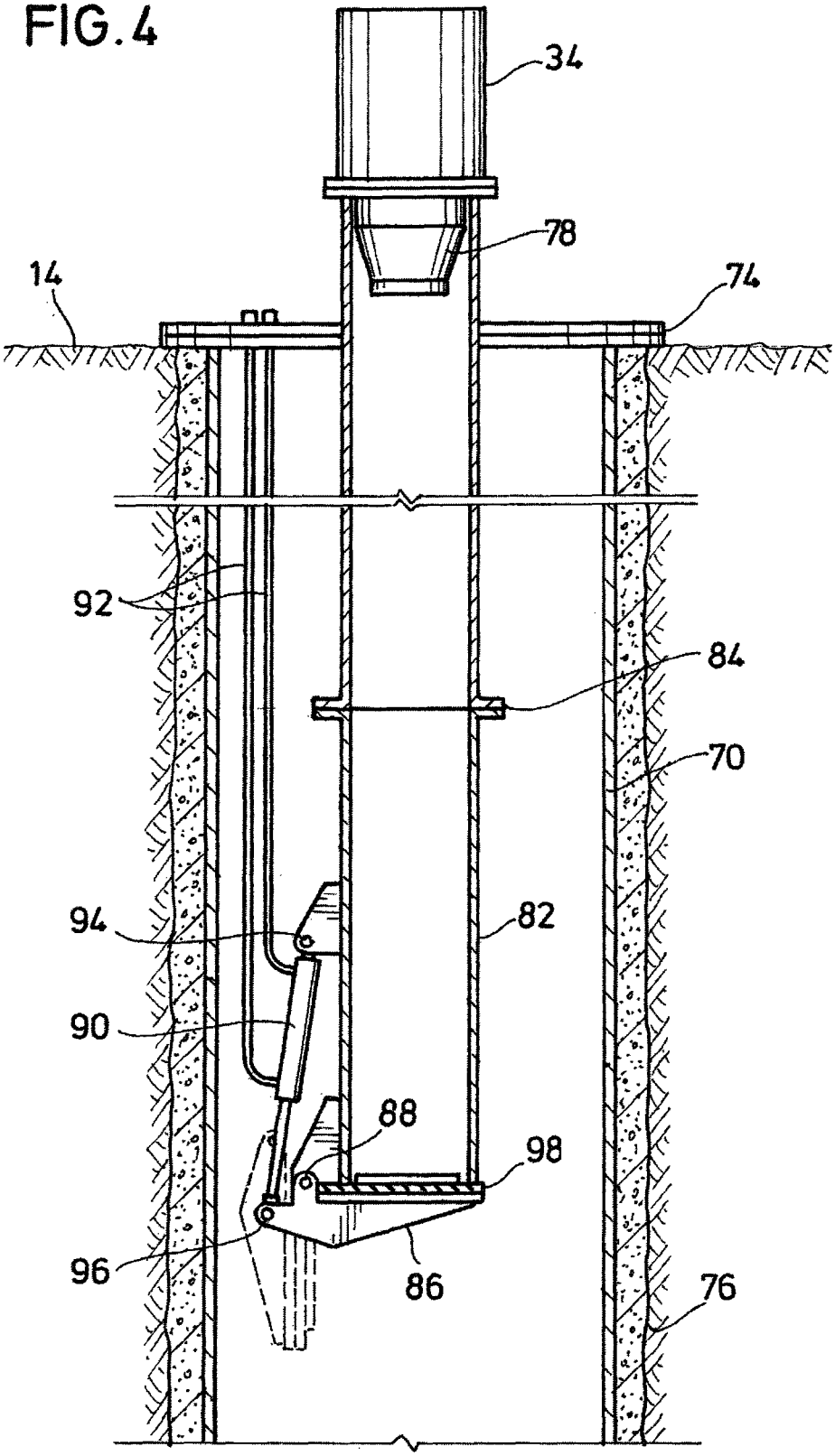
FIG. 4 is a partial, cross-sectional view of the upper portion of a large diameter injection water well with a hydraulically actuated valve opening or closing a lower end of a drop pipe.

To prevent having to repeatedly kill the well 76, the temporary drilling header 74 has been modified so that a drop pipe 82 extends downward from the temporary drilling header 74. See FIG. 4. While the length of the drop pipe 82 may vary, it is estimated that drop pipe would be approximately two hundred feet in length. The drop pipe 82 is attached at the upper end to temporary drilling header 74. Flanges 84 are welded, or threaded connections may be used to add the necessary length to the drop pipe.

On the lower end of the drop pipe 82 is located a valve 86 that is pivotally mounted on pivot pin 88. The operation of the hydraulic cylinder 90 causes valve 86 to be opened or closed. Hydraulic fluid for the hydraulic cylinder 90 is provided through hydraulic hoses 92. Each end of the hydraulic cylinder 90 is free to pivot on pivot pins 94 and 96. If the valve 86 is closed, a rubber sealing element 98 prevents leakage through the drop pipe 82.

Figure 5:
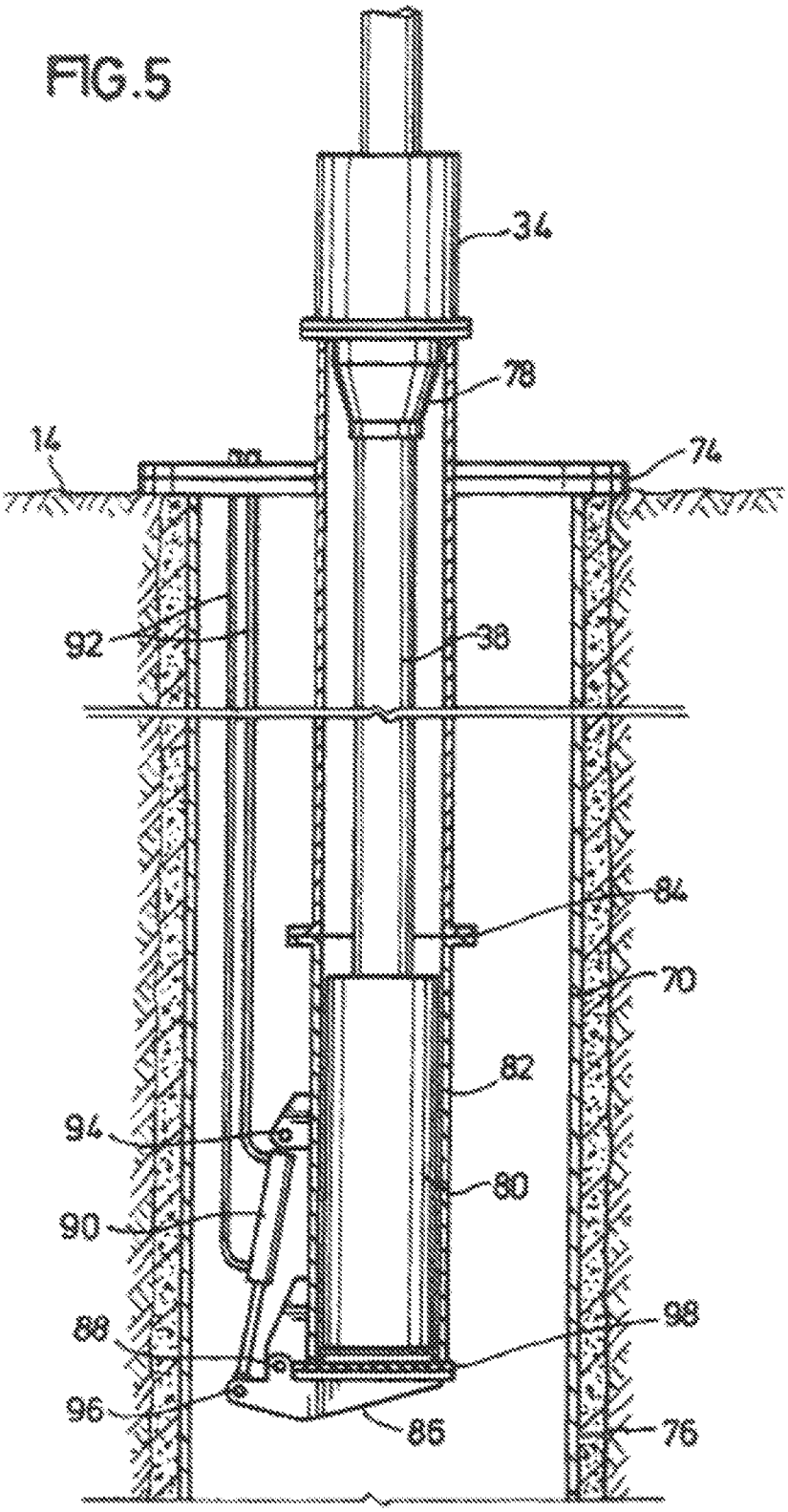
FIG. 5 is a partial, cross-sectional view of the upper portion of a large diameter injection water well having a drop pipe with a bottom hole assembly therein prior to opening a lower valve.
Figure 6:
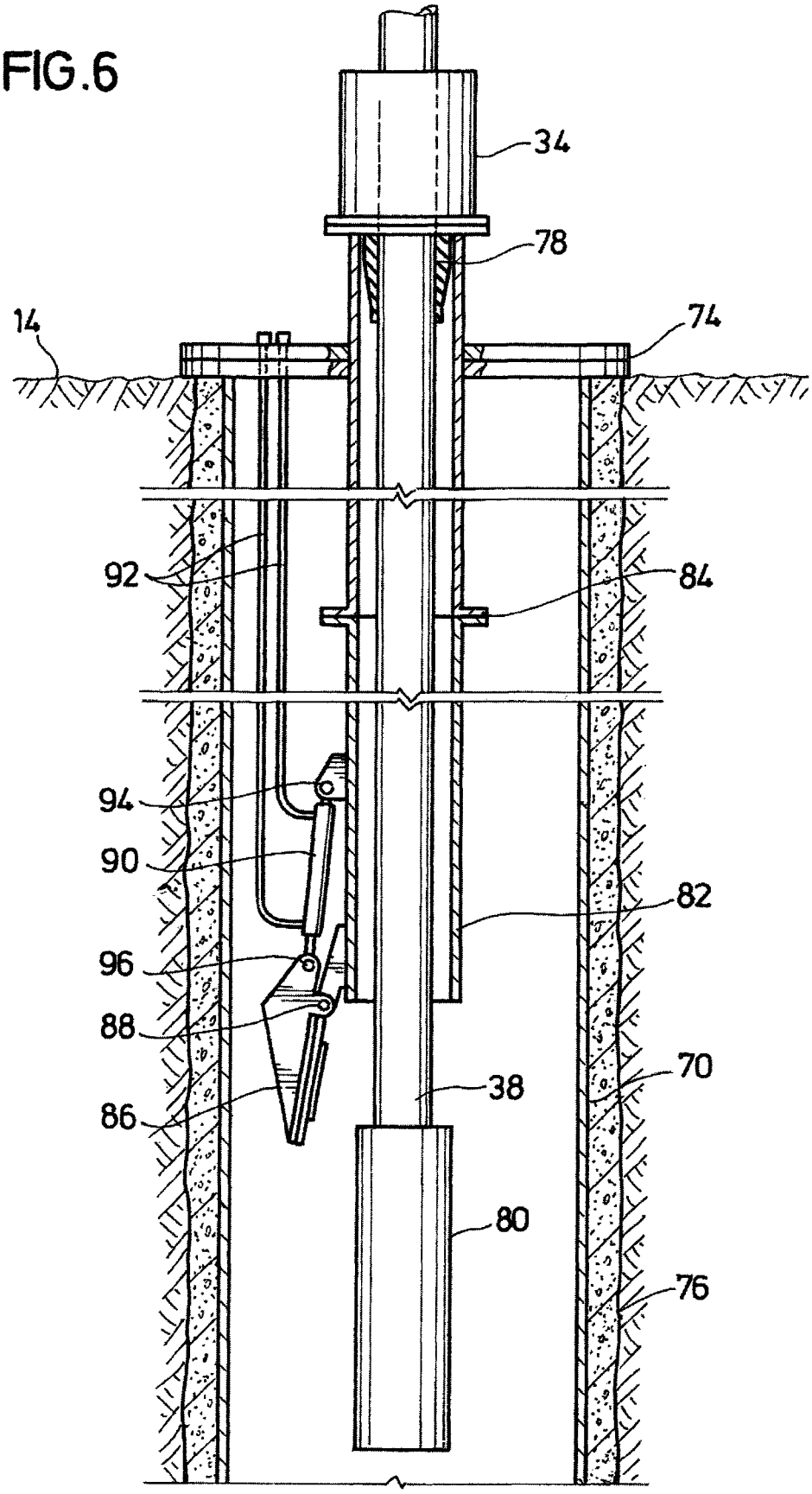
FIG. 6 is a partial, cross-section of the upper portion of a large diameter injection water well with a bottom hole assembly extending through a drop pipe and a lower valve into lower portions of the large diameter injection water well.

Referring to FIGS. 5 and 6 in combination, the present invention will be illustrated in further detail. In FIG. 5 the well 76 is being drilled into the earth 14. The initial steel casing 70 has been snubbed in into position and cemented in place. The 44" steel casing 72 (See FIG. 3) may, or may not, need suppression while it is being installed. A temporary drilling header 74 is installed at the top of the steel casing 70. The drop pipe 82 extends downward from the temporary drilling header 74. In the FIG. 5 hydraulic cylinder 90 has closed the valve 86 located at the bottom of the drop pipe 82. With the valve of 86 closed, drill pipe 38 along with bottom hole assembly 80 are lowered into the drop pipe 82. The upper part of the drill pipe 38 is sealed with the stripper rubber 78 and turned by rotary table 34.

Pressure inside of the well 76 does not need to be suppressed or killed when inserting drill string 38 and bottom hole assembly 80 because valve 86 is closed with rubber sealing 98 preventing leakage there through. After the bottom hole assembly 80 is inside of drop pipe 82, then stripper rubber 78 and rotary table 34 are secured to the drill string 38. By opening the valve 86 with the hydraulic cylinder 90, the drill string 38 and the bottom hole assembly 80 can be lowered to the bottom of well 76. The bottom hole assembly 80 can include drill bit for drilling the hole deeper or a drill collar. The bottom hole assembly 80 can include coring equipment to get core samples. For injection water wells in Florida, it is important to run logging tools into the pilot holes.

With the use of the drop pipe 82 just as described in FIGS. 5 and 6, numerous trips can be made into the well 76 without having to kill or suppress the well. Pilot holes can be drilled and logged. Smaller 34" steel casing 100, and 24" steel casing 102 can be installed and cemented in place using tremie tubing (not shown). It is only necessary to kill or suppress the well 76 one time[; namely, when] after the drop pipe 82 is [being] removed following [at] the final completion of each successive steel casing 72, 100 and 102, respectively, of the well 76.

We claim:

1. A process for drilling a water injection well using a drilling derrick with rotary drilling, including a rotary table, drill pipe, attachments, and blowout preventer, initially using drilling mud, a source of power outside said injection well, said process including the following steps:

(a) drilling a first hole with said drill pipe and said drilling derrick;
(b) snubbing in a casing having a diameter smaller than said hole;
(c) drilling a first pilot hole below the lower end of said casing;
(d) installing a temporary well header below said rotary drive and said blowout preventors;
(e) attaching a drop pipe to an underside of said temporary well header, which drop pipe extends downward therefrom, diameter of said drop pipe being larger than said attachments but less than said casings;
(f) said drop pipe having a valve secured on a lower end of said drop pipe;
(g) pivotally connecting an actuator to said valve to open or close a bottom opening in said drop pipe, said actuator being opened or closed by said source of power from outside said injection well;
(h) lowering said drill pipe and attachments into said drop pipe with said valve being closed;
(i) securing said rotary drive and stripper rubber to said drill pipe above said temporary well header;
(j) opening said valve with said actuator;
(k) repeatedly extending said drill pipe and attachments into said pilot hole for as needed testing;
(l) repeatedly retracting said drilling pipe and attachment back into said drop pipe during said testing;
(m) closing said valve with said actuator;
(n) killing said well and removing said temporary well header;
(o) removing said drilling pipe, attachment and drop pipe;
(p) reinserting said drilling pipe to drill a reduced diameter casing hole to receive a reduced diameter casing therein;
(q) cementing said reduced diameter casing;
(r) repeating steps (c) through (q) for each successively smaller diameter casing being inserted therein.

2. The process for drilling a water injection well as recited in claim 1 wherein said actuator is a hydraulic cylinder pivotally connected to said valve to open or close said bottom opening, said hydraulic cylinder being operated by hydraulic fluid provided by said source of power.

3. The process for drilling a water injection well as recited in claim 2 wherein during repeating steps (c)-(q) drilling of a second pilot hole occurs through said reduced diameter casing and testing in said second pilot hole occurs without killing or suppressing said water injection well until said second pilot hole is drilled and said needed testing is complete.

4. The process for drilling a water injection well as recited in claim 3 wherein during repeating steps (c)-(q) drilling of a third pilot hole occurs through a second reduced diameter casing, and testing in said third pilot hole occurs without killing or suppressing said water injection well until said second pilot hole is drilled and said needed testing is complete.

5. The process for drilling a water injection well as recited in claims 3 or 4 wherein during repeating steps (c)-(q) logging equipment is lowered through said drop pipe to run logs of said water injection well, said logging occurring without killing or suppressing said water injection well.

6. The process for drilling a water injection well as recited in claims 3 or 4 wherein during said repeating steps core sampling equipment is lowered through said drop pipe to take samples in said pilot holes of said injection well as it is being drilled, said sampling occurring without killing or suppressing said water injection well.

* * * * *